United States Patent [19]

Thomas et al.

[11] Patent Number: 4,975,212

[45] Date of Patent: Dec. 4, 1990

[54] FLUORINATED LUBRICATING COMPOSITIONS

[75] Inventors: Raymond H. P. Thomas, Amherst; David P. Wilson, Williamsville; David Nalewajek, West Seneca; Hang T. Pham, North Tonawanda, all of N.Y.

[73] Assignee: Allied-Signal Inc., Morristown, N.J.

[21] Appl. No.: 290,120

[22] Filed: Dec. 27, 1988

[51] Int. Cl.[5] ..... C10M 105/52; C07C 43/12

[52] U.S. Cl. ..... 252/54; 252/52 A; 252/58; 252/68; 568/615

[58] Field of Search ..... 568/615; 252/54, 68

[56] References Cited

U.S. PATENT DOCUMENTS

| | | | |
|---|---|---|---|
| 2,723,999 | 11/1955 | Cowen et al. | 568/615 |
| 3,483,129 | 12/1969 | Dolle, Jr. et al. | 252/49.9 |
| 4,052,277 | 10/1977 | Martini | 204/158 R |
| 4,079,084 | 3/1978 | Houghton | 568/615 |
| 4,118,398 | 10/1978 | Martini | 260/340.6 |
| 4,267,064 | 5/1981 | Sasaki et al. | 252/52 A |
| 4,379,768 | 4/1983 | Yamabe et al. | 260/544 F |
| 4,428,854 | 1/1984 | Enjo et al. | 252/69 |
| 4,431,557 | 2/1984 | Shimizu et al. | 252/52 A |
| 4,443,349 | 4/1984 | Snyder, Jr. et al. | 252/49.9 |
| 4,454,052 | 6/1984 | Shoji et al. | 252/68 |
| 4,497,720 | 2/1985 | Moriga et al. | 252/54 |
| 4,675,452 | 6/1987 | Lagow et al. | 568/601 |
| 4,699,969 | 10/1987 | Re et al. | 528/70 |
| 4,755,316 | 7/1988 | Magid et al. | 252/68 |

FOREIGN PATENT DOCUMENTS

| | | | |
|---|---|---|---|
| 2750980 | 5/1979 | Fed. Rep. of Germany . | |
| 3611302 | 10/1987 | Fed. Rep. of Germany | 568/615 |
| 51795 | 3/1982 | Japan . | |
| 21632 | 2/1984 | Japan | 252/68 |
| 96684 | 5/1985 | Japan . | |
| 87-02992 | 5/1987 | PCT Int'l Appl. . | |
| 87-02993 | 5/1987 | PCT Int'l Appl. . | |
| 88-00963 | 2/1988 | PCT Int'l Appl. . | |
| 1087283 | 10/1967 | United Kingdom . | |
| 1354138 | 5/1974 | United Kingdom | 568/615 |

OTHER PUBLICATIONS

Downing, Fluorocarbon Refrigerant Handbook, pp. 13–14.

Kruse et al., Fundamentals of Lubrication in Refrigerating Systems and Heat Pumps, pp. 763–783.

Sanvordenner et al., A Review of Synthetic Oils for Refrigeration Use, pp. 14–19.

Spauschus, Evaluation of Lubricants for Refrigeration and Air-Conditioning Compressors.

Chapter 32 of the 1980 ASHRAE Systems handbook.

Research Disclosure 17463.

*Primary Examiner*—Olik Chaudhuri

*Assistant Examiner*—E. McAvoy

*Attorney, Agent, or Firm*—Melanie L. Brown; Jay P. Friedenson

[57] ABSTRACT

The present invention provides a novel lubricating composition comprising a polyoxyalkylene glycol having a cap of a fluorinated alkyl group on at least one end thereof. The composition has a molecular weight between 300 and 3,000, a viscosity of about 5 to about 150 centistokes at 37° C., and a viscosity index of at least 20. The composition is miscible in combination with tetrafluoroethane in the range between −40° C. and at least +20° C.

The novel lubricating composition is particularly useful with tetrafluoroethane in refrigeration and air-conditioning applications. As such, the present invention also provides a composition for use in refrigeration and air-conditioning comprising: (a) tetrafluoroethane; and (b) a sufficient amount to provide lubrication of at least one polyoxyalkylene glycol having a cap of fluorinated alkyl group on at least one end thereof. The lubricant has a molecular weight of about 300 to about 3,000, a viscosity of about 5 to about 150 centistokes at 37° C., and a viscosity index of at least 20. The lubricant is miscible in combination with the tetrafluoroethane in the range between about −40° C. and at least about +20° C.

21 Claims, No Drawings

FLUORINATED LUBRICATING COMPOSITIONS

BACKGROUND OF THE INVENTION

The present invention relates to novel lubricating compositions and their use with refrigerants. More particularly, the present invention relates to novel lubricating compositions for use with tetrafluoroethane and preferably, 1,1,1,2-tetrafluoroethane (known in the art as R134a). R134a is a refrigerant which may replace dichlorodifluoromethane (known in the art as R12) in many applications because environmental concerns over the use of R12 exist.

R134a has been mentioned as a possible replacement for R12 because concern over potential depletion of the ozone layer exists. R12 is used in closed loop refrigeration systems; many of these systems are automotive air-conditioning systems. R134a has properties similar to those of R12 so that it is possible to substitute R134a for R12 with minimal changes in equipment being required. The symmetrical isomer of R134*a* is R134 (1,1,2,2-tetrafluoroethane); the isomer is also similar in properties and may also be used. Consequently, it should be understood that in the following discussion, "tetrafluoroethane" will refer to both R134 and R134a.

A unique problem arises in such a substitution. Refrigeration systems which use R-12 generally use mineral oils to lubricate the compressor; the present discussion does not apply to absorption refrigeration equipment. See for example the discussion in Chapter 32 of the 1980 ASHRAE Systems Handbook. R-12 is completely miscible with such oils throughout the entire range of refrigeration system temperatures which may range from about −45.6° to 65.6° C. Consequently, oil which dissolves in the refrigerant travels around the refrigeration loop and generally returns with the refrigerant to the compressor. The oil does not separate during condensation, although it may accumulate because low temperatures exist when the refrigerant is evaporated. At the same time, the oil which lubricates the compressor contains some refrigerant which may affect its lubricating property.

It is known in the industry that chlorodifluoromethane (known in the art as R22) and monochlorodifluoromethane/1-chloro-1,1,2,2,2-pentafluoroethane (known in the art as R502) are not completely miscible in common refrigeration oils. See Downing, FLUOROCARBONS REFRIGERANT HANDBOOK, p. 13. A solution to this problem has been the use of alkylated benzene oils. Such oils are immiscible in R134a and are not useful therewith. This problem is most severe at low temperatures when a separated oil layer would have a very high viscosity. Problems of oil returning to the compressor would be severe.

R134a is not miscible with mineral oils; consequently, different lubricants will be required for use with R134a. However, as mentioned above, no changes to equipment should be necessary when the refrigerant substitution is made. If the lubricant separates from the refrigerant, it is expected that serious operating problems could result. For example, the compressor could be inadequately lubricated if refrigerant replaces the lubricant. Significant problems in other equipment also could result if a lubricant phase separates from the refrigerant during condensation, expansion, or evaporation. These problems are expected to be most serious in automotive air-conditioning systems because the compressors are not separately lubricated and a mixture of refrigerant and lubricant circulates throughout the entire system.

These problems have been recognized generally in the refrigeration art. Two recent publications by ASHRAE suggest that separation of lubricants and refrigerants presents problems, although no mention is made of R134a. These articles are Kruse et al., "Fundamentals of Lubrication in Refrigeration Systems and Heat Pumps," *ASHRAE TRANSACTIONS* 90(2*B*), 763 (1984) and Spauschus, "Evaluation of Lubricants for Refrigeration and Air-Conditioning Compressors," ibid, 784.

The following discussion will be more readily understood if the mutual solubility of refrigerants and various lubricating oils is considered in general with specific reference to R134a. Small amounts of lubricants may be soluble in R134a over a wide range of temperatures, but as the concentration of the lubricant increases, the temperature range over which complete miscibility occurs, i.e., only one liquid phase is present, narrows substantially. For any composition, two consolute temperatures, i.e., a lower and a higher temperature, may exist. That is, a relatively low temperature below which two distinct liquid phases are present and above which the two phases become miscible and a higher temperature at which the single phase disappears and two phases appear again may exist. A diagram of such a system for R502 refrigerant is shown as FIG. 2 in the Kruse et al. paper mentioned above. A range of temperatures where one phase is present exists and while it would be desirable that a refrigeration system operate within such a range, it has been found that for typical compositions, the miscible range of lubricants with R134a is not wide enough to encompass the typical refrigeration temperatures.

Some disclosures which are concerned with the choice of lubricants when R134a is used as a refrigerant exist. Polyalkylene glycols were suggested to be used in Research Disclosure 17483, October 1978 by DuPont. Specific reference was made to such oils produced by Union Carbide Corporation under the trade names "ULCON" (sic) LB-165 and UCON 525. It is stated that these oils are miscible in all proportions with R134a at temperatures at least as low as −50° C. It is believed that "ULCON" (sic) LB-165 and UCON 525 are polyoxypropylene glycols which have a hydroxy group at one end of each molecule and a n-butyl group at the other end.

The use of synthetic oils for refrigeration systems including polyoxyalkylene glycols is discussed by Sanvordenker et al, in a paper given at a ASHRAE Symposium, June 29, 1972. The authors made the point that polyglycols should properly be called ethers and esters rather than glycols because the terminal hydroxyl groups are bound by ester or ether groups. It is stated that this substitution makes them suitable for lubrication.

U.S. Pat. No. 4,428,854 discloses the use of R134a as an absorption refrigerant where organic solvents are used as absorbing agents. An example is tetraethylene glycol dimethyl ether. A related patent U.S. Pat. No. 4,454,052 also discloses polyethylene glycol methyl ether used as an absorbent along with certain stabilizing materials for refrigerants such as 134a.

Japanese Patent Publication 96684 dated May 30, 1985 addresses the stability problems of refrigerants. The reference teaches that perfluoro ether oligomers are one class of useful lubrication oils.

U.S. Pat. No. 4,267,064 also recommends the use of polyglycol oils, particularly for rotary compressors. It is indicated that viscosities in the range of 25–50 centistokes (CS) at 98.9° C. are needed plus a viscosity index greater than 150. Many refrigerants are mentioned but not tetrafluoroethane.

Japanese Published application No. 51795 of 1982 relates to antioxidants and corrosion inhibitors for use with various polyether type synthetic oils. The tests were carried out with R-12, which does not exhibit the immiscible character of R134a.

U.S. Pat. No. 4,431,557 relates to additives used in synthetic oils. Many refrigerants are mentioned, but not tetrafluoroethane, and the patentees gave no indication of concern for miscibility of the refrigerants and the lubricants.

Commonly assigned U.S. Pat. No. 4,755,316 teaches a compression refrigeration composition. The refrigerant is tetrafluoroethane while the lubricant is at least one polyoxyalkylene glycol which is at least difunctional with respect to hydroxyl groups, has a molecular weight between 300 and 2,000, has a viscosity of about 25–150 centistokes at 37° C., has a viscosity index of at least 20, and is miscible in combination with the tetrafluoroethane in the range between −40° C. and at least +20° C. The reference does not teach or suggest the present fluorinated lubricating compositions.

U.K. Patent 1,087,283; U.S. Pat. Nos. 3,483,129; 4,052,277; 4,118,398; 4,379,768; 4,443,349; and 4,675,452: and International Publications WO 87/02992 and WO 87/02993 teach perfluorinated ethers and perfluoropolyethers as lubricants. The references do not teach the present fluorinated lubricating compositions and the references do not teach that their lubricants are useful with R134a.

Because it is expected that R134a will become widely used in the field of refrigeration and air-conditioning, new improved lubricants useful with R134a are needed in the art.

SUMMARY OF THE INVENTION

The present invention responds to the foregoing need in the art by providing new lubricatinq compositions. The lubricatinq composition comprises a polyoxyalkylene glycol having a cap of a fluorinated alkyl group on at least one end thereof. The composition has a molecular weight between 300 and 3,000, a viscosity of about 5 to about 150 centistokes at 37° C., and a viscosity index of at least 20. The composition is miscible in combination with tetrafluoroethane in the range between −40° C. and at least +20° C. Preferably, the viscosity of the composition is about 35 to about 150 centistokes at 37° C.

Preferably, the novel lubricating composition comprises the formula (I)

$$R_1OR_2—[CHR_3CH(CH_3)O]_m(CH_2CH_2O)_n—R_4$$

wherein $R_3$ is hydrogen or $—CH_3$, m is 4 to 36, n is 0 to 36, $R_2$ is $—CH(CH_3)CH_2—$ or a direct bond and $R_1$ and $R_4$ are independently selected from the group consisting of hydrogen, alkyl group, and fluorinated alkyl group. At least one of $R_1$ and $R_4$ is a fluorinated alkyl group. Examples of alkyl groups include methyl, ethyl, propyl, and butyl. As such, the present lubricating composition may be terminated by a hydrogen at one end and a fluorinated alkyl group at the other end, by an alkyl group at one end and a fluorinated alkyl group at the other end, or by a fluorinated alkyl group at both ends. The fluorinated alkyl group may be branched or straight chain as long as fluorine atoms are attached thereto.

The present lubricating compositions may be formed by fluorinating polyoxyalkylene glycols. The polyoxyalkylene glycols used may have primary carbons at both ends, a primary carbon at one end and a secondary carbon at the other end or secondary carbons at both ends. Preferably, the polyoxyalkylene glycols used have a primary carbon at one end and a secondary carbon at the other end or secondary carbons at both ends.

In a more preferred embodiment at least one of $R_1$ and $R_4$ is a fluorinated alkyl group of the formula (II)

$$—(CH_2)_x(CF_2)_yCF_3$$

wherein x is 1 to 4 and y is 0 to 15. More preferably, x is 1 and y is 0 so that at least one of $R_1$ and $R_4$ is a fluorinated alkyl group of the formula $—CH_2CF_3$ or x is 1 and y is 2 so that at least one of $R_1$ and $R_4$ is a fluorinated alkyl group of the formula $—CH_2(CF_2)_2CF_3$. Even more preferably, both $R_1$ and $R_4$ are fluorinated alkyl groups, m is 14 to 34, and n is 0.

The most preferred lubricating compositions are $$CF_3CH_2O[CH_2CH(CH_3O)]_mCH_2CF_3$$

$$CF_3(CF_2)_2CH_2O[CH_2CH(CH_3)O]_mCH_2(CF_2)_2CF_3$$

$$CH_3CH_2OCH(CH_3)CH_2O[CH_2CH(CH_3)O]_mCH_2CF_3$$

$$CF_3(CF_2)_2CH_2OCH(CH_3)CH_2O[CH_2CH(CH_3)O]_mCH_2(CF_2)_2CF_3$$

where m is 14 to 34.

Generally, the novel lubricatinq compositions may be formed by capping a polyoxyalkylene glycol with at least one fluorinated alkyl group. The present novel lubricating compositions may be formed by copolymerizing ethylene and propylene oxides and terminating the resulting copolymer with at least one fluorinated alkyl group.

Preferably, the novel lubricating compositions wherein one end has an alkyl group and the other end has a fluorinated alkyl group or both ends have fluorinated alkyl groups are formed as follows. The polyoxyalkylene glycol is converted to the tosylate by treatment with p-toluenesulfonyl chloride in a suitable base such as pyridine and then the tosylated polyglycol is reacted with the sodium alkoxide of the appropriate fluorinated alcohol.

Preferably, the novel lubricating compositions wherein one end has a hydroxyl group and the other end has a fluorinated alkyl group are formed as follows. An alcohol initiator such as the sodium alkoxide of trifluoroethanol is used in the polymerization of polypropylene oxide.

The present invention also provides a composition for use in refrigeration and air-conditioning comprising: (a) tetrafluoroethane and (b) a sufficient amount to provide lubrication of at least one polyoxyalkylene glycol having a cap of a fluorinated alkyl group on at least one end thereof. This lubricant has a molecular weight of about 300 to about 3,000, a viscosity of about 5 to about 150 centistokes at 37° C., and a viscosity index of at least 20. The lubricant is miscible in combination with the tetrafluoroethane in the range between about −40° C. and at least about +20° C. Preferably, the viscosity of the lubricant is about 35 to about 150 centistokes at 37° C.

When used in combination with R134a, the present lubricants provide improved ranges of miscibility. Comparable to the refrigeration lubricants of commonly assigned U.S. Pat. No. 4,755,316, the present lubricants when used with R134a have low upper critical solution temperatures (UCST) which are consistent over a range of viscosities taken at 37° C. Although the compositions of commonly assigned U.S. Pat. No. 4,755,316 exhibit wide miscibility ranges, it has been found that the present lubricants have higher lower critical solution temperatures (LCST), over a range of viscosities taken at 37° C. compared with the lubricants of commonly assigned U.S. Pat. No. 4,755,316. The term "higher lower critical solution temperatures" as used herein means the following. For the known lubricants of commonly assigned U.S. Pat. No. 4,755,316 assume that with a first fixed viscosity at 37° C. the miscibility range with R134a extends to a LCST of T1. In contrast with the present lubricants at the same viscosity, the miscibility range with R134a extends to a LCST of T2 wherein T2>T1. This unexpectedly superior property provides better operations at higher temperatures due to improved miscibility. Thus, the present lubricants when used with R134a are advantageous to use because they have wide miscibility ranges with consistent low UCSTs and higher LCSTs.

The present invention also provides a method for improving lubrication in refrigeration and air-conditioning equipment using tetrafluoroethane as a refrigerant. The method comprises the step of: employing as a lubricant at least one polyoxyalkylene glycol having a cap of a fluorinated alkyl group on at least one end thereof. The lubricant has a molecular weight of about 300 to about 3,000 has a viscosity of about 5 to about 150 centistokes at 37° C., and a viscosity index of at least 20. The lubricant is miscible in combination with the tetrafluoroethane in the range between about −40° C. and at least about +20° C.

Other advantages of the present invention will become apparent from the following description and appended claims.

DETAILED DESCRIPTION OF THE PREFERRED EMBODIMENT

Refrigerants

The present novel lubricating compositions may be used in most lubricating applications but they are particularly useful with R134a.

The invention relates to the substitution of tetrafluoroethane, and preferably, 1,1,1,2-tetrafluoroethane for R-12 which has been considered to present a danger to the atmospheric ozone layer. R134a has physical characteristics which allow its substitution for R-12 with only a minimum of equipment changes although it is more expensive and unavailable in large quantities at the present time. Its symmetrical isomer, R134, may also be used. The detrimental effect of tetrafluoroethane on atmospheric ozone is considered to be much less than the effect of R-12, and therefore, the substitution of tetrafluoroethane for R-12 is considered probable in the future.

It has been found that the present lubricants are also suitable for use with R12, R22, and R502 which are all refrigerants now available in commercial quantities. A composition for use in refrigeration and air-conditioning comprising: (a) R12, R22, or R502; and (b) the present novel lubricating compositions may be used until R134a becomes available in commercial quantities. However, it should be understood that only blends of tetrafluoroethane with other refrigerants which are miscible with the lubricants of the invention in the range of about −40° C. to at least +20° C. are included.

R-12 is used in very large quantities and of the total, a substantial fraction is used for automotive air-conditioning. Consequently, the investigation of the lubricants needed for use with R134a (or R134) has emphasized the requirements of automotive air-conditioning since the temperature range is generally higher than that of other refrigeration systems., i.e., about 0° C. to 93° C. Since it has been found that R134a differs in being much less miscible with common lubricants than R-12, the substitution of refrigerants becomes more difficult.

Lubricants

R-12 is fully miscible in ordinary mineral oils and consequently, separation of the lubricants is not a problem. Although it is similar to R12, R134a is relatively immiscible in many lubricants as may be seen by reference to commonly assigned U.S. Pat. No. 4,755,316. Thus, it is necessary to find suitable lubricants which are miscible with R134a (or R134) to avoid refrigerant and lubricant separation.

It is characteristic of some refrigerant-lubricant mixtures that a temperature exists above which the lubricant separates. Since this phenomenon occurs also at some low temperatures, a limited range of temperatures within which the two fluids are miscible may occur. Ideally, this range should span the operating temperature range in which the refrigerant is to operate, but often this is not possible. It is typical of automotive air-conditioning systems that a significant fraction of the circulating charge is lubricant and the refrigerant and lubricant circulate together through the system. Separation of the lubricant and refrigerant as they return to the compressor could result in erratic lubrication of the moving parts and premature failure. Other air-conditioning system types usually circulate only the relatively smaller amount of lubricant which is carried by the refrigerant gas passing through the compressor and should be less sensitive to the separation problem. Especially with automotive air-conditioning, separation of the relatively large amount of lubricant circulating with the refrigerant can also affect the performance of other parts of the system.

In a typical automotive air-conditioning system, the temperatures at which the refrigerant is condensed originally will be about 50°-70° C. but may reach 90° C. in high ambient temperature operation. The condensation of hot refrigerant gases in the condensing heat exchanger can be affected if the exchanger is coated with lubricant preferentially so that condensation of the refrigerant occurs by contact with the lubricant film. Thereafter, the two-phase mixture of lubricant and refrigerant must pass through a pressure reduction to the low temperature stage where the refrigerant evaporates and absorbs the heat given up in cooling air and condensing moisture. If lubricant separates at the condenser, then the performance of the evaporator stage can be affected if separate phases persist as the two-phase mixture passes through the pressure reduction step. As with the condenser, accumulation of lubricant on the evaporator coils can affect heat exchange efficiency. In addition, the low evaporator temperatures may result in excessive cooling of the lubricant resulting in a more viscous liquid and trapping of the lubricant in the evaporator. These problems can be avoided if the lubricant and the refrigerant are fully miscible throughout the operating temperature ranges, as was true with R-12 and mineral oil mixtures. R134a, with its limited ability to dissolve lubricants, presents a problem which must be solved.

The present lubricants nave higher low critical solution temperatures when used with R134a and consequently, they are an improvement on the compositions of tetrafluoroethane and polyoxyalkylene glycols of commonly assigned U.S. Pat. No. 4,755,316. The present lubricants operate without separation from R134a over much of the operating temperature range. Any separation which does occur would preferably be at the higher temperatures, and thus, would affect the condenser rather than the lower temperature evaporator.

A blend of the present lubricating compositions wherein the compositions have different molecular weights may be used in practicing the present invention.

The present lubricating compositions are miscible in combination with tetrafluoroethane in the range between about −40° C. and at least about +20° C., preferably at least about +30° C., more preferably at least about +40° C., and most preferably at least about +50° C.

Preferably, the tetrafluoroethane and lubricant are used in a weight ratio of about 99:1 to about 1:99, and more preferably, in a weight ratio of about 99:1 to about 70:30.

The range of miscibility is not the only factor to be considered when one is selecting a lubricant for automotive air-conditioning service (or other refrigeration applications). Lubricating properties also must be satisfactory for the intended application. Practically, this means that for automotive air conditioning, the viscosity of the lubricant will be about 5–150 centistokes, preferably about 100 centistokes (CS) at 37° C. with a viscosity index of at least 20 in order that the lubricant is sufficiently viscous at high temperatures to lubricate while remaining sufficiently fluid to circulate around the refrigeration circuit at low temperatures. The range of viscosity may also be expressed as about 3–24 CS at 98.9° C. In addition, the lubricant should be chemically stable and not cause corrosion or other problems in long-term service. Other factors which should be considered in selecting lubricants are compatibility, lubricity, safety, and the like.

Additives which may be used to enhance performance include (1) extreme pressure and antiwear additives, (2) oxidation and thermal stability improvers, (3) corrosion inhibitors, (4) viscosity index improvers, (5) pour and floc point depressants, (6) detergent, (7) anti foaming agents, and (8) viscosity adjusters. Typical members of these classes are listed in TABLE 1 below.

TABLE 1

| Class Additive | Typical Members of the Class |
|---|---|
| 1. Extreme pressure and anti-wear | phosphates, phosphate esters (bicresyl phosphate), phosphites, thiophosphates (zinc diorganodithiophosphates) chlorinated waxes, sulfurized fats and olefins, organic lead compounds, fatty acids, molybdenum complexes, halogen substituted organosilicon compounds, borates, organic esters, halogen substituted phosphorous compounds, sulfurized Diels Alder adducts, orqanic sulfides, compounds containing chlorine and sulfur, metal salts of organic acids. |
| 2. Oxidation and thermal stability improvers | sterically hindered phenols (BHT), aromatic amines, dithiophosphates, phosphites, sulfides, metal salts of dithio acids. |
| 3. Corrosion Inhibitors | organic acids, organic amines, organic phosphates, organic alcohols, metal sulfonates, organic phosphites. |
| 4. Viscosity index improvers | polyisobutylene, polymethacrylate, polyalkylstyrenes. |
| 5. Pour Point &/ or floc point depressants | polymethacrylate ethylene-vinyl acetate copolymers, succinamic acid-olefin copolymers, ethylene-alpha olefin copolymers, Friedel-Crafts condensation products of wax with naphthalene or phenols. |
| 6. Detergents | sulfonates, long-chain alkyl substituted aromatic sulfonic acids, phosphonates, thiophosphonates, phenolates, metal salts of alkyl phenols, alkyl sulfides, alkylphenol-aldehyde condensation products, metal salts of substituted salicylates, N-substituted oligomers or polymers from the reaction products of unsaturated anhydrides and amines, copolymers of methacrylates with N-substituted compounds such as N-vinyl pyrrolidone or dimethylaminoethyl methacrylate, copolymers which incorporate polyester linkages such as vinyl acetate maleic anhydride copolymers. |
| 7. Anti-Foaming Agents | silicone polymers |
| 8. Viscosity Adjusters | Polyisobutylene, polymethacrylates, polyalkylstyrenes, naphthenic oils, alkylbenzene oils, paraffinic oils, polyesters, polyvinylchloride, polyphosphates. |

The present invention is more fully illustrated by the following non-limiting Examples.

COMPARATIVES 1–6

For comparative purposes, the following Table 2 was generated based on the compositions of R134a and polyoxyalkylene glycols in TABLE A of commonly assigned U.S. Pat No. 4,755,316 except that 14 wt. % glycol was used. The polyoxyalkylene glycols have the formula $$HOCH(CH_3)CH_2O[CH_2CH(CH_3)O]_mH$$

TABLE 2

| Comp. | Glycol | Visc. (CS) | m | MW | Glycol Wt. % | Misc. (°C.) |
|---|---|---|---|---|---|---|
| 1 | NIAX 425 | 33 | 8 | 450 | 14 | −60 to over 80(A) |
| 2 | — | 56 | 13 | 750 | 14 | −60 to 72(E) |
| 3 | NIAX 1025 | 77 | 17 | 1000 | 14 | −60 to 57(E) |
| 4 | PPG 1200 | 91 | 21 | 1200 | 14 | −60 to 50(A) |
| 5 | — | 127 | 27 | 1580 | 14 | −60 to 32(E) |

TABLE 2-continued

| Comp. | Glycol | Visc. (CS) | m | MW | Glycol Wt. % | Misc. (°C.) |
|---|---|---|---|---|---|---|
| 6 | PPG 2000 | 165 | 34 | 2000 | 14 | −60 to 13(A) |

(A) in Table 2 indicates that actual measurements were taken while (E) indicates that the values were extrapolated from a graph of the actual data.

COMPARATIVES 7-11

Comparatives 7-11 demonstrate that perfluorinated ethers and perfluoropolyethers are not useful as lubricants with R134a because they are immiscible with R134a over a wide temperature range which is unsuitable for automotive air-conditioning purposes. Most automotive air-conditioners operate at about 0° to 93° C. and useful lubricants operated at about −30° to 93° C. Table 3 contains the results of the Comparatives. The viscosities are at 37° C.

TABLE 3

| COMP. | ETHER | VISC. (CS) | MW | ETHER WT. % | MISC (°C.) |
|---|---|---|---|---|---|
| 7 | KRYTOX 143AB (Dupont) | 85 | 3700 | 15 | Immiscible at and below 10.2 |
| 8 | KRYTOX 143AX | 150 | 4800 | 15 | Immiscible at and below 20.4 |
| 9 | KRYTOX 143CZ | 125 | 4400 | 15 | Immiscible at and below 19.6 |
| 10 | BRAYCO 1724 (Bray) | 65.5 | — | 15 | Immiscible at and below 18.4 |
| 11 | S-100 (Daikin) | 100 | 4600 | 15 | Immiscible at and below 30.0 |

EXAMPLES 1-6

Examples 1-6 are directed to the preparation of lubricating compositions of the formula $CF_3CH_2OCH(CH_3)CH_2O[CH_2CH(CH_3)O]_mCH_2CF_3$ and mixtures thereof.

A lubricating composition of the above formula wherein m is 15 was prepared by as follows.

Part A is directed to the preparation of ditosylates of propylene glycol.

5 gallons (0.02 $m^3$) of polypropylene glycol were added to a premixed solution containing 18.6 kg of p-toluenesultonyl chloride and 7.5 gallons (0.03 $m^3$) of pyridine. The reaction temperature was maintained at 5°-10° C. during this addition. After stirring for an additional 4 hours to complete the formation of the ditosylate, the reaction mixture was quenched with 10 gallons (0.04 $m^3$) of water.

The product was isolated from the pyridine/water solution by extracting the mixture with 28 L of butylether. The butylether extract was washed with 10N hydrochloric acid solution (10 gallons) (0.04 $m^3$), then with 3 gallons (0.01 $m^3$) of a 3% hydroxide/10% sodium chloride solution. The ether layer was dried by stirring over sodium sulfate (1 kg) then filtered. The resulting butylether-product solution contained 32.6 kg of the ditosylate, representing a yield of 90%.

Part B is directed to the the preparation of bis (trifluoroethyl) polypropylene glycol.

Sodium trifluoroethanolate was prepared by reacting 3 kg of sodium metal with 2.6 gallons (0.01 $m^3$) of trifluoroethanol in 10 gallons (0.04 $m^3$) of butyl ether. After the formation of the sodium salt was complete, the ditosylate-butylether solution from Part A was added as rapidly as possible. The reaction temperature was raised to 90° C. and maintained overnight to complete the formation of the capped material. After cooling to room temperature, 5 gallons (0.02 $m^3$) of water were added to the reaction kettle to remove the by-product sodium tosylate. The ether solution was washed successively with 10 gallons (0.04 $m^3$) of 3% sodium hydroxide, 5 gallons (0.02 $m^3$) of 6N hydrochloric acid and 5 gallons (0.02 $m^3$) of saturated sodium carbonate. The butylether was removed by distillation. The bis-capped trifluoroethyl oil remained in the reaction kettle. Yield of the colorless to faint yellow oil was 27.6 kg representing a yield of 90%.

The general procedure described above was followed to prepare the other members of this series. The amount of p-toluenesulfonyl chloride was adjusted based on the molecular weight of the starting polypropylene glycol to produce a mole ratio of the reactants to be 2.2 to 1. Similarly, the mole ratio of sodium trifluoroethanolate was adjusted appropriately to yield a mole ratio of reactants of 2.5 to 1.

These compositions with their molecular weights are listed in Table 4 below.

TABLE 4

| LUBRICATING COMPOSITION | m | MW |
|---|---|---|
| EX. 1 | 15 | 991 |
| EX. 2 | 20 | 1366 |
| EX. 3 | 26 | 1666 |
| EX. 4 | 29 | 1866 |
| EX. 5 | 34 | 2166 |

The miscibility of the lubricating compositions was determined by combining them with refrigerant in a glass tube and observing the results when the tubes were maintained at preselected temperatures. A tube was filled with the desired amount of lubricant and then refrigerant was added while the oil was frozen in liquid nitrogen. The tube was then sealed and immersed in a thermostated bath. After the temperature was equilibrated, the miscibility of the lubricant and refrigerant was determined by visual observation. The results of the tests made with R-134a and the lubricating compositions of Examples 1-6 are shown in Table 5 below.

TABLE 5

| | VISC. (CS) | MW | EX WT % | MISC (°C.) |
|---|---|---|---|---|
| Ex. 1 | 33 | 991 | 14 | −60 to over 70 |
| Ex. 2 | 56 | 1366 | 14 | −60 to over 81 |
| | | | 50 | −60 over 70 |
| Ex. 3 | 78 | 1666 | 14 | −60 to 67 |
| | | | 50 | −60 to over 70 |
| Ex. 4 | 91 | 1866 | 6.04 | −60 to 64.2 |
| | | | 14.82 | −60 to 59.5 |
| | | | 22.4 | −60 to 63.3 |
| | | | 30.4 | −60 to 67.0 |
| | | | 38.8 | −60 to 75 |
| | | | 49.7 | −60 to 74 |
| Ex. 5 | 127 | 2166 | 14 | −60 to 42.6 |
| | | | 50 | −60 to over 70 |
| Ex. 6 | 91 | | 14 | −60 to 58 |

Example 6 is 44/56 wt. % mixture of Example 1/Example 4.

The new lubricating compositions range in viscosity at 37° C. from 35 to 150 cs. All the oils were found to be completely miscible at lower temperatures as shown by the fact that they are all miscible down to −60° C. For about 14 wt. %. the low critical solution temperature limit ranges from over 70° C. for Example 1 to 42.6° C. for Example 5.

Example 6 shows that it is practical to use mixtures of the lubricating compositions to achieve any desired viscosity.

A comparison as set forth below of the present compositions of TABLE 5 at 14 wt. % lubricant with the known compositions of TABLE 2 shows the unexpectedly superior higher upper miscibility temperatures of the present compositions. At a viscosity of 56 CS, Comparative 2 has an upper miscibility temperature of 72° C. while Example 2 has an upper miscibility temperature of higher than 81° so that the temperature difference is at least 9° C. At a viscosity of 77–78 CS, Comparative 3 has an upper miscibility temperature of 57° C. while Example 3 has an upper miscibility temperature of 67° C. so that the temperature difference is 10° C. At a viscosity of 91 CS, Comparative 4 has an upper miscibility temperature of 50° C. while Example 4 has an upper miscibility temperature of 59.5° C. so that the temperature difference is 9.5° C. At a viscosity of 127 CS, Comparative 5 has an upper miscibility temperature of 32° C. while Example 5 has an upper miscibility temperature of 42.6° C. so that the temperature difference is 10.6° C. As such, the present compositions have higher upper miscibility range temperatures.

EXAMPLE 7

Example 7 is directed to the preparation of a lubricating composition of the formula $$CF_3(CF_2)_2CH_2OCH(CH_3)CH_2O[CH_2CH(CH_3)]_{26}CH_2(CF_2)_2CF_3$$

This lubricating composition was prepared as follows.

The general procedure described above in Examples 1–4 was used to prepare the bis-capped derivative of Example 7.1H,1H-perfluorobutanol was used as the starting alcohol rather than trifluoroethanol.

The miscibility was determined according to the procedure in Examples 1–5. The results are set forth in TABLE 6 below.

TABLE 6

| | VISC. (CS) | MW | EX WT % | MISC (°C.) |
|---|---|---|---|---|
| Ex. 7 | 78 | 1866 | 14.78 | −60 to 77.2 |
| | | | 51.09 | −60 to over 78.8 |

The lubricating composition of Example 7 has the same viscosity at 37° C. as the lubricating composition of Example 3. At 14 wt %, the Example 3 composition has a miscible range of −60° to 67° C. while the Example 7 composition has a miscible range of −60° to 77.2° C.

This is an improvement of 10° C. This Example demonstrates that as the y value of Formula (II) above increases, an increase in the miscible range of the refrigerant oil mixture occurs.

COMPARATIVE 12 AND EXAMPLE 8

The lubricating composition of Comparative 12 was a copolymer of ethylene and propylene oxides having the formula $$H_9C_4O—(CH_2CH(CH_3)O)_m(CH_2CH_2O)_n—H$$

This copolymer is 50HB660 and was purchased from Union Carbide. According to Union Carbide's literature, this copolymer has a MW of 1590 with equal amounts by weight of ethylene and propylene oxide. For Example 8, the copolymer of Comparative 12 was fluorinated to provide a lubricating composition wherein the hydroxyl end was fluorinated.

The miscibilities were determined according to the procedure in Examples 1–5. The results are set forth in TABLE 7 below.

TABLE 7

| | VISC. (CS) | MW | EX WT % | MISC (°C.) |
|---|---|---|---|---|
| COMP. 12 | 143 | 1590 | 14 | −60 to 32 |
| Ex. 8 | 62 | 1673 | 14.9 | −60 to 61 |
| | | | 50.6 | −60 to over 74 |

A comparison of Comparative 12 to Example 8 demonstrates that the miscibility of the polyoxyalkylene glycol drastically improves upon fluorination.

EXAMPLES 9–12

Examples 9–12 are directed to the preparation of lubricating compositions of the formula $$HOCH(CH_3)CH_2O[CH_2CH(CH_3)O]_mCH_2CF_3$$

Lubricating compositions of the above formula wherein m is as indicated in TABLE 8 below are prepared by following the general procedure of Examples 1–5 above and adjusting the ratio of reactants to 1:1 to produce monocapped derivatives.

TABLE 8

| LUBRICATING COMP. | m |
|---|---|
| Ex. 9 | 20 |
| Ex. 10 | 26 |
| Ex. 11 | 29 |
| Ex. 12 | 34 |

EXAMPLES 13–16

Examples 13–16 are directed to the preparation of lubricating compositions of the formula $$H_3COCH(CH_3)CH_2O[CH_2CH(CH_3)O]_mCH_2CF_3$$

Lubricating compositions of the above formula wherein m is as indicated in TABLE 9 below are prepared by following the general procedure of Example 1–5 above and using the mono-methyl capped glycol instead of polyproplylene glycol diols.

TABLE 9

| LUBRICATING COMP. | m |
|---|---|
| Ex. 13 | 20 |
| Ex. 14 | 26 |
| Ex. 15 | 29 |
| Ex. 16 | 34 |

EXAMPLES 17–20

Examples 17–20 are directed to the preparation of lubricating compositions of the formula $$HOCH(CH_3)CH_2O[CH_2CH(CH_3)O]_mCH_2(CF_2)_2CF_3$$

Lubricating compositions of the above formula wherein m is as indicated in TABLE 10 below are prepared by following the general procedure of Examples 1–5 above and using 1H,1H-perflourobutanol instead of trifluoroethanol.

TABLE 10

| LUBRICATING COMP. | m |
|---|---|
| Ex. 17 | 20 |
| Ex. 18 | 26 |
| Ex. 19 | 29 |
| Ex. 20 | 34 |

EXAMPLES 21–24

Examples 21–24 are directed to the preparation of lubricating compositions of the formula $$R_1OCH(CH_3)CH_2O[CH_2CH(CH_3)O]_mCH_2(CF_2)_2CF_3$$

Lubricating composition of the above formula wherein m is 20 and $R_1$ is as indicated in TABLE 11 below are prepared by following the general procedure of Examples 1–5 above and using 1H,1H-perfluorobutanol instead of trifluorethanol.

TABLE 11

| LUBRICATING COMP. | $R_1$ |
|---|---|
| Ex. 21 | $H_3C$ |
| Ex. 22 | $H_5C_2$ |
| Ex. 23 | $H_7C_3$ |
| Ex. 24 | $H_9C_4$ |

EXAMPLES 25–28

Examples 25–28 are directed to the preparation of lubricating compositions of the formula $$HOCH(CH_3)CH_2O[CH(CH_3)CH(CH_3)O]_mCH_2CF_3$$

Lubricating compositions of the above formula wherein m is as indicated in TABLE 12 below are prepared by following the general procedure of Examples 1–5 above and using polybutylene glycol instead of polypropylene glycol.

TABLE 12

| LUBRICATING COMP. | m |
|---|---|
| Ex. 25 | 20 |
| Ex. 26 | 26 |
| Ex. 27 | 29 |
| Ex. 28 | 34 |

EXAMPLES 29–32

Examples 29–32 are directed to the preparation of lubricating compositions of the formula $$H_3COCH(CH_3)CH_2O[CH(CH_3)CH(CH_3)O]_mCH_2CF_3$$

Lubricating compositions of the above formula wherein m is as indicated in TABLE 13 below are prepared by following the general procedure of Examples 1–5 above and using methyl capped polybutylene glycol instead of polypropylene glycol.

TABLE 13

| LUBRICATING COMP. | m |
|---|---|
| Ex. 29 | 20 |

TABLE 13-continued

| LUBRICATING COMP. | m |
|---|---|
| Ex. 30 | 26 |
| Ex. 31 | 29 |
| Ex. 32 | 34 |

EXAMPLES 33–36

Examples 33–36 are directed to the preparation of lubricating compositions of the formula $$F_3CH_2COCH(CH_3)CH_2O[CH(CH_3)CH(CH_3)O]_mCH_2CF_3$$

Lubricating compositions of the above formula wherein m is as indicated in TABLE 14 below are prepared by following the general procedure of Examples 1–5 above and using polybutylene glycol instead of polypropylene glycol.

TABLE 14

| LUBRICATING COMP. | m |
|---|---|
| Ex. 33 | 20 |
| Ex. 34 | 26 |
| Ex. 35 | 29 |
| Ex. 36 | 34 |

Having described the invention in detail and by reference to preferred embodiments thereof, it will be apparent that modifications and variations are possible without departing from the scope of the invention defined in the appended claims.

What is claimed is:

1. A lubricating composition comprising a polyoxyalkylene glycol having a cap of a fluorinated alkyl group on at least one end thereof wherein said polyoxyalkylene glycol is formed from copolymer of ethylene oxide and propylene oxide, copolymer of ethylene oxide and butylene oxide, or copolymer of propylene oxide and butylene oxide and said composition has a molecular weight between 300 and 3,000, a viscosity of about 5 to about 150 centistokes at 37° C., and a viscosity index of at least 20, and is miscible in combination with tetrafluoroethane in the range between −40° C. and at least +20° C.

2. The lubricating composition of claim 1 wherein said composition has the formula $$R_1OR_2[CHR_3CH(CH_3)O]_m(CH_2CH_2O)_n—R_4$$

wherein $R_3$ is hydrogen or —$CH_3$, m is 4 to 36, n is 0 to 36, $R_2$ is —$CH(CH_3)CH_2O$— or a direct bond, and $R_1$ and $R_4$ are independently selected from the group consisting hydrogen, alkyl group, and fluorinated alkyl group.

3. The lubricating composition of claim 2 wherein $R_2$ is —$CH(CH_3)CH_2O$—.

4. The lubricating composition of claim 2 wherein $R_2$ is a direct bond.

5. The lubricating composition of claim 2 wherein $R_3$ is $CH_3$.

6. The lubricating composition of claim 2 wherein at least one of said $R_1$ and $R_4$ is a fluorinated alkyl group of the formula —$(CH_2)_x(CF_2)_yCF_3$ wherein x is 1 to 4 and y is 0 to 15.

7. The lubricating composition of claim 1 Wherein said viscosity is about 35 to about 150 centistokes at 37° C.

8. The lubricating composition of claim 4 wherein both of said $R_1$ and $R_4$ are fluorinated alkyl groups.

9. A composition for use in refrigeration and air-conditioning comprising:

(a) tetrafluoroethane; and (b) a sufficient amount to provide lubrication of at least one polyoxyalkylene glycol having a cap of a fluorinated alkyl group on at least one end thereof wherein said lubricant has a molecular weight of about 300 to about 3,000, a viscosity of about 5 to about 150 centistokes at 37° C., and a viscosity index of at least 20, and is miscible in combination with said tetrafluoroethane in the range between about −40° C. and at least about +20° C.

10. The composition of claim 9 wherein said tetrafluoroethane is 1,1,1,2-tetrafluoroethane.

11. The composition of claim 9 wherein the miscible range is between about −40° C. and at least about +30° C.

12. The composition of claim 9 wherein the miscible range is between about −40° C. and at least about +40° C.

13. The composition of claim 9 wherein the miscible range is between about −40° C. and at least about +50° C.

14. The composition of claim 9 wherein said lubricant has the formula $$R_1OR_2—[CHR_3CH(CH_3)O]_m(CH_2CH_2O)_n—R_4$$

wherein $R_1$ and $R_4$ are independently selected from the group consisting of hydrogen, alkyl group, and fluorinated alkyl group, m is 4 to 36, n is 0 to 36, $R_2$ is $—CH(CH_3)CH_2O—$ or a direct bond, and $R_3$ is hydrogen or $—CH_3$.

15. The composition of claim 14 wherein $R_2$ is a direct bond.

16. The composition of claim 14 wherein $R_3$ is $CH_3$.

17. The composition of claim 14 wherein at least one of said $R_1$ and $R_4$ is a fluorinated alkyl group of the formula $—(CH_2)_x(CF_2)_yCF_3$ wherein x is 1 to 4 and y is 0 to 15.

18. The composition of claim 14 wherein said viscosity is about 35 to about 150 centistokes at 37° C.

19. The composition of claim 15 wherein both of said $R_1$ and $R_4$ are fluorinated alkyl groups.

20. A method for improving lubrication in refrigeration and air-conditioning equipment using tetrafluoroethane as a refrigerant comprising the step of:

employing as a lubricant at least one polyoxyalkylene glycol having a cap of a fluorinated alkyl group on at least one end thereof wherein said lubricant has a molecular weight of about 300 to about 3,000, a viscosity of about 5 to about 150 centistokes at 37° C., and a viscosity index of at least 20, and is miscible in combination with said tetrafluoroethane in the range between about −40° C. and at least about +20° C.

21. A composition for us in refrigeration and air-conditioning comprising:

(a) a refrigerant selected from the group consisting of dichlorodifluoromethane, chlorodifluoromethane and monochlorodifluoromethane/1-chloro-1,1,2,2,2-pentafluoroethane; and (b) a sufficient amount to provide lubrication of at least one polyoxyalkylene glycol having a cap of a fluorinated alkyl group on at least one end thereof wherein said lubricant has a molecular weight of about 300 to about 3,000, a viscosity of about 5 to about 150 centistokes at 37° C., and a viscosity index of at least 20, and is miscible in combination with said refrigerant in the range between about −40° C. and at least about +20° C.

* * * * *